US007513463B2

(12) United States Patent
Rossmann et al.

(10) Patent No.: US 7,513,463 B2
(45) Date of Patent: Apr. 7, 2009

(54) RAIL-GUIDED TRANSPORT SYSTEM

(75) Inventors: Martin Rossmann, Oberhausen (DE); Karsten Jaeger, Waltrop (DE)

(73) Assignee: DM Technologies GmbH & Co KG, Ladbergen (DE)

( * ) Notice: Subject to any disclaimer, the term of this patent is extended or adjusted under 35 U.S.C. 154(b) by 356 days.

(21) Appl. No.: 10/583,708

(22) PCT Filed: Aug. 10, 2004

(86) PCT No.: PCT/DE2004/001790

§ 371 (c)(1),
(2), (4) Date: Jul. 6, 2006

(87) PCT Pub. No.: WO2005/061299

PCT Pub. Date: Jul. 7, 2005

(65) Prior Publication Data

US 2007/0051856 A1 Mar. 8, 2007

(30) Foreign Application Priority Data

Dec. 20, 2003 (DE) ..... 103 60 089

(51) Int. Cl.
*G06F 17/00* (2006.01)

(52) U.S. Cl. ..... 246/1 C; 246/3; 246/4; 180/168; 340/435; 340/903; 701/301

(58) Field of Classification Search ..... 246/1 R, 246/1 C, 3, 4, 167, 182 R, 186, 187 R, 187 A, 246/187 B, 192 R, 201; 180/168, 169; 340/435, 340/903; 356/4.01; 701/301; 359/726
See application file for complete search history.

(56) References Cited

U.S. PATENT DOCUMENTS 4,049,961 A * 9/1977 Marcy ..... 250/202
4,345,662 A * 8/1982 Deplante ..... 180/168

(Continued)

FOREIGN PATENT DOCUMENTS

DE 88 16 616 U 2/1990

(Continued)

OTHER PUBLICATIONS

International Search Report PCT/DE2004/001790 (no pub. date).

(Continued)

*Primary Examiner*—Mark T Le
(74) *Attorney, Agent, or Firm*—Collar & Roe, P.C.

(57) ABSTRACT

The invention relates to a rail-guided system for transporting persons and material in underground mining and tunnel construction. The rail-guided transport system comprises a railroad network and transport vehicles that are guided in the railroad network. In the transport system, both the forward end and the opposite end of the respective transport vehicle are equipped with sensors (1-6) for detecting optical, acoustic, thermal, and acceleration data, "forward" being relative to the direction of travel. The sensors (1-6) are connected to a control computer that is disposed inside the transport vehicle while interacting with active and passive transducers located within the railroad network.

8 Claims, 2 Drawing Sheets

U.S. PATENT DOCUMENTS

| | | | | |
|---|---|---|---|---|
| 5,294,081 | A | 3/1994 | Malon | |
| 5,988,306 | A * | 11/1999 | Ooishi | 180/168 |
| 6,290,188 | B1 * | 9/2001 | Bassett | 246/182 R |
| 6,592,080 | B2 * | 7/2003 | Murata et al. | 246/1 C |
| 7,205,730 | B2 * | 4/2007 | Taguchi | 318/69 |
| 7,411,744 | B2 * | 8/2008 | Chen | 359/726 |
| 2002/0185572 | A1 | 12/2002 | Kyutoku et al. | |
| 2003/0146069 | A1 | 8/2003 | Kaiser | |

FOREIGN PATENT DOCUMENTS

| | | | |
|---|---|---|---|
| DE | 39 38 858 | A | 5/1991 |
| DE | 40 14 700 | A | 11/1991 |
| DE | 197 38 629 | A | 3/1999 |
| EP | 0 496 650 | A | 7/1992 |
| EP | 1 216 910 | A | 6/2002 |
| WO | WO 00/52851 | A | 9/2000 |
| WO | WO 02/14133 | A | 2/2002 |

OTHER PUBLICATIONS

Frederich F. et al.: "Automatisches Fahren-Beispiele Aus Dem Gueterverkehr" Zeitschrift Fur Eisenbahnwesen Und Verkehrstechnik. Die Eisenbachntechnik + Glasers Annalen, Georg Siemens Verlagsbuchhandlung. Berlin, DE, vol. 121, No. 11, Nov. 1997, pp. 571-574, 576, XP000722196. ISSN: 0941-0589. (ISR).

* cited by examiner

RAIL-GUIDED TRANSPORT SYSTEM

CROSS REFERENCE TO RELATED APPLICATONS

Applicants claim priority under 35 U.S.C. §119 of German Application No. 103 60 089.2 filed Dec. 20, 2003. Applicants also claim priority under 35 U.S.C. §365 of PCT/DE2004/001790 filed Aug. 10, 2004. The international application under PCT article 21(2) was not published in English.

BACKGROUND OF THE INVENTION

1. Field of the Invention

The invention relates to a rail-guided transport system for persons and material in underground mining and tunnel construction, consisting of a railway network and transport vehicles guided in this railway network.

2. Description of Related Art

A plurality of extensive railway networks exists in the operations of Deutsche Steinkohle AG, on which several hundred transport vehicles are operated. These transport vehicles are, on the one hand, two-track ground railways, but also single-track suspended railways (EHB), which are driven by locomotives or trolleys having a diesel drive or electric (battery) drive.

These transport vehicles are operated by drivers who are trained specifically for this purpose, who control the transport vehicle in a driver's cabin disposed on the transport vehicle, whereby such a driver's cabin is generally present on each side of the transport vehicle.

The plurality of the transport vehicles and the transport operation, which in part occurs in multiple shifts, require a correspondingly great expenditure for driver personnel, which can hardly be reduced, because of the limited travel speed underground, with a simultaneously increasing transport volume. Driving orders that overlap shifts cannot be handled, in part, and this results in an increased need to keep transport capacity available.

In part, manual driving results in great material stresses (during start-up and braking). Furthermore, the driver entry and exit procedures, specifically, represent a major area of accidents for drivers on single-track suspended railways.

A prerequisite for safe operation of the transport systems being discussed is the ability to recognize any object situated in the working space of the transport system, reliably and at any time, and to derive appropriate measures on this basis.

In this connection, human beings as drivers of the transport vehicles represent one of the weakest links in the chain.

Independent, i.e. automatic operation of rail transport, for example, is known and has been in use in German coal mining since the 1980s. However, these systems could only be operated with extraordinary technical and organizational effort (e.g. prohibition against persons being in the vicinity of the vehicles). The introduction of magnetic railway technology using autonomous vehicles, which was originally planned, failed due to great safety requirements, among other things.

SUMMARY OF THE INVENTION

The invention is therefore based on the task of configuring a rail-guided transport system of the type stated initially, in such a manner that autonomous operation, i.e. unmanned operation, is made possible with simple means.

The invention accomplishes this task, in that the transport vehicle, in each instance, is equipped with sensors for detecting optical, acoustical, temperature, and acceleration data both at its front end, in the direction of travel, and at its opposite end, which sensors are connected with a control computer disposed in the transport vehicle, whereby the sensors interact with active and passive signal transmitters in the railway network.

With the invention, the result is achieved that transport systems guided on rails autonomously carry out driving orders to be transmitted electronically, without thereby representing a hazard for human beings and the surroundings. At the same time, the combination of the rail-guided transport system with the necessary sensor systems allows collision-free driving operation.

The recognition of objects and possible collisions is independent of ambient conditions such as dust, darkness, heat, high humidity, etc., by means of the use of suitable sensors.

According to a preferred embodiment, the invention suggests ultrasound sensors, laser scanners, infrared sensors, acceleration sensors, imaging sensors, and microphones as suitable sensors, whereby the ultrasound sensors, the laser scanner, and the infrared and imaging sensors monitor the travel path for collision hazards, while the acceleration sensors are responsible for monitoring machine diagnoses, and the microphones are responsible for acoustically monitoring the surroundings.

The sensors are connected with the control computer in the transport vehicle, in which computer the data that come from the sensors are processed.

According to a further embodiment, each process computer is part of a telematics system that monitors and controls the transport system. Such computer systems are already being used in underground mining for machine diagnosis. Retrofitting the transport vehicles with robust control computers that are suitable for use in the industry can therefore be achieved at reasonable expenditure.

In the case of unmanned operation, a continuous communications infrastructure is desirable.

This can ideally be achieved, according to the present state of the art, using the established wireless LAN technology. For this purpose, the track is equipped with so-called Hot Spot regions. In these regions, continuous radio communication is available. In this connection, the density of the Hot Spot regions that must be set is dependent on the technical features of the rail network. Hot Spots must be set up at least at central stations, switches, branches, and destination points.

An alternative is seen in the so-called Leaky Feeder technology, with an antenna line composed of leak wave guides, for continuous date transmission over the entire travel path.

In this manner, the entire transport system, with the plurality of transport vehicles, can be easily monitored from a central control station.

A particular advantage of the transport system according to the invention, in this connection, is the saving in personnel costs, since no drivers are needed; gentle operation of the transport system by means of uniform driving behavior; continuous operation over multiple shifts; no need to keep unnecessary transport capacities available; elimination of drivers' stations or consoles, thereby achieving a reduction in the dead weight load; no accidents as the machine drivers enter and exit; qualitative monitoring of the travel path, i.e. track with regard to its condition and changes, by means of comparing the current path data with archived path data.

Furthermore, standing water as well as damage to the track base that has resulted from swelling can be detected on the travel path, switches can be activated, the switch position can be queried. Voice communication can take place by way of microphones and loudspeakers affixed to the vehicles. Location data can be transmitted at the Hot Spot regions in each instance. Swaying transport loads can be taken into consideration in the case of single-track suspended railway operations, by means of the acceleration sensors.

According to a further embodiment, the vehicles can also be equipped with on-board cameras. In this way, containers (for example water troughs that serve as explosion barriers) in the region of the travel path can be examined by way of the telematics control station, by remote control.

Since, according to a further embodiment, end station and stop station signal transmitters that can be freely positioned are installed in the railway network, the vehicles automatically stop at material reloading stations and destinations; because of the constant dynamics of the railway network in mining operations, these are subject to constant changes.

In this connection, the required sensor system for monitoring and checking the region of effect is installed and affixed in such a manner that driving operation on both sides is possible. In other words, the two driver's cabins at the ends of the transport vehicle are replaced by the "sensor heads" that have been described.

In the central station regions or at destinations, the vehicles are taken over by the employees. This is supposed to take place by means of manual radio remote controls, particularly in order to control the loading and unloading. After the work on site has been completed, the vehicles are activated again, by way of the manual radio remote control, and put back into automatic operation.

DETAILED DESCRIPTION OF PREFERRED EMBODIMENTS

Figure 1:
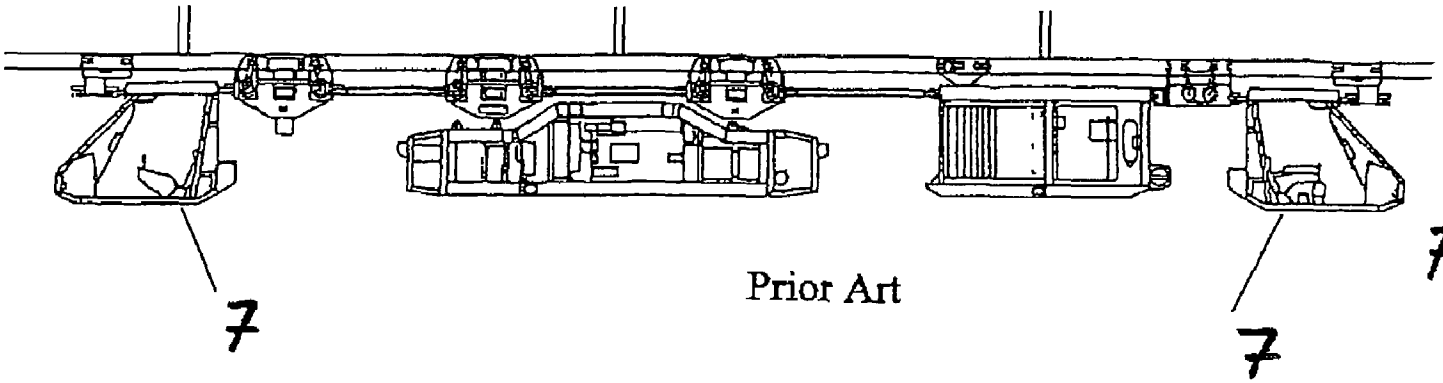
Prior Art Fig. 1
FIG. 1 shows a conventional single-track suspended railway with drivers' cabins.
Figure 2:
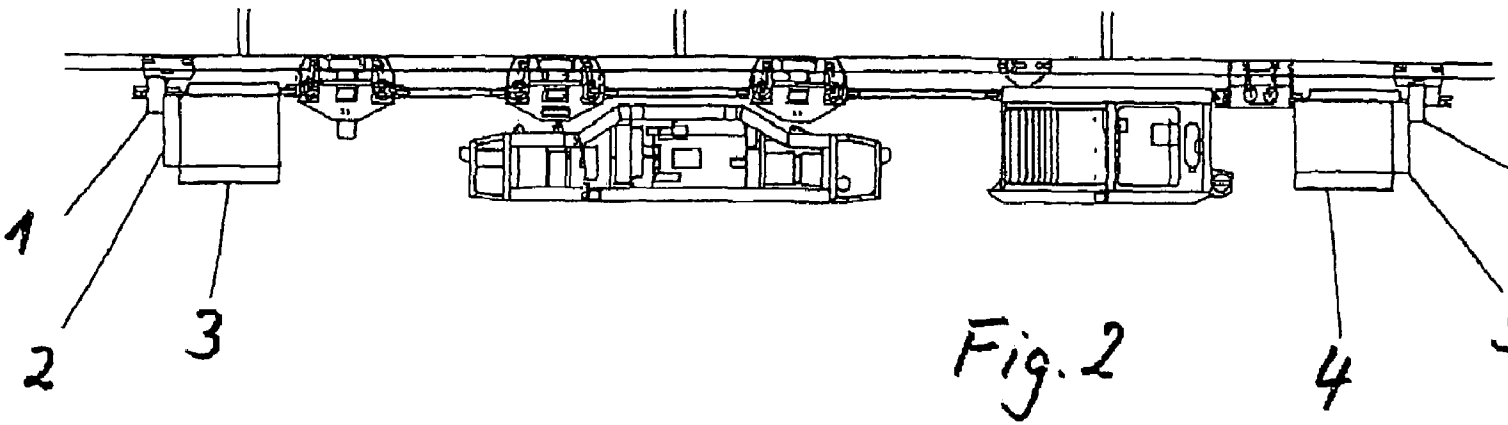
FIG. 2 shows a single-track suspended railway equipped according to the invention in which the drivers' cabins have been removed and replaced with sensors.

In the attached FIGS. 1 and 2, the invention is shown using the example of a single-track suspended railway, whereby FIG. 1 shows the conventional single-track suspended railway with drivers', cabins 7, while FIG. 2 shows the single-track suspended railway equipped according to the invention, in which the drivers' cabins 7 have been removed, and instead of them, sensors 1 to 6 have been disposed.

In this connection, the sensors 1 and 6 serve to monitor the rail guidance, the sensors 2 and 5 to monitor the travel path, and the sensors 3 and 4 to monitor the sub-ground (distance from floor, standing water).

The sensors are implemented as a pair, in each instance, so that the single-track suspended railway can be operated in both directions.

Depending on the task, the sensors 1 to 6 can be ultrasound sensors, infrared sensors, imaging sensors, laser scanners, etc.

To warn the surroundings, the single-track suspended railway is provided with optical and acoustical signal transmitters, such as all-around lights, horns, etc.; however, these are not shown.

Figure 3:
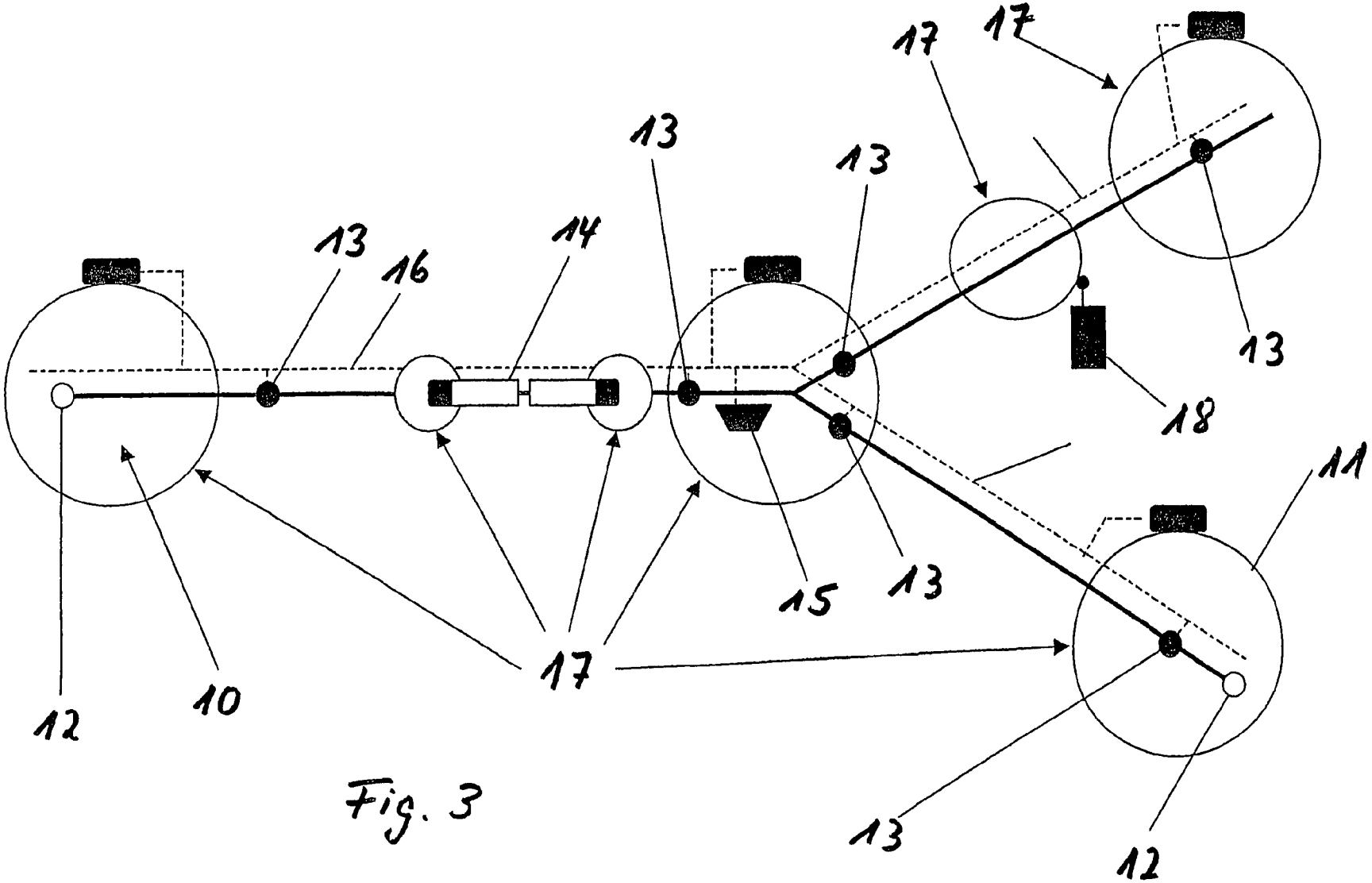
FIG.3 is a railway diagram showing an embodiment of the invention.

FIG. 3 shows a railway diagram as an example. The departure station is designated as 10, the destination (e.g. tunneling location) is designated as 11. (Mobile) end position transducers 12, as well as position transducers 13 for location determination, are disposed in these regions.

In this example, the single-track suspended railway 14 is situated in front of a railway branch having the switch 15.

The broken line represents the telematics bus (leaky feeder) and is provided with the reference symbol 16.

The circles 17 represent the Hot Spot regions for the wireless LAN technology for the telematics control of the system, used in the present example.

A mobile manual radio remote control 18, with which the vehicle 14 can be taken over by employees, particularly in order to control loading and unloading, is indicated schematically.

The invention claimed is:

1. Rail-guided transport system for persons and material in underground mining and tunnel construction, consisting of a railway network and transport vehicles guided in this railway network, wherein the transport vehicle, in each instance, is equipped with sensors (1-6) for detecting optical, acoustical, temperature, and acceleration data both at its front end, in the direction of travel, and at its opposite end, whereby one of the sensors is a laser scanner and the sensors are connected with a control computer disposed in the transport vehicle, which computer is part of a telematics system that monitors and controls the transport system, whereby the sensors interact with active and passive signal transmitters in the railway network, in which end station and stop station signal transmitters that can be freely positioned can be installed.

2. Rail-guided transport system according to claim 1, wherein the control computer is connected with the telematics system by way of wireless LAN technology, whereby the railway network is divided up into several Hot Spot regions.

3. Rail-guided transport system according to claim 1, wherein a Leaky Feeder antenna line is provided for data transmission and over the entire travel path.

4. Rail-guided transport system according to claim 1, wherein the transport vehicle is equipped with optical and acoustical signal transmitters.

5. Rail-guided transport system according to claim 1, wherein the transport vehicle is a single-track suspended railway.

6. Rail-guided transport system according to claim 1, wherein the transport vehicle is a ground railway.

7. Rail-guided transport system according to claim 1, wherein ultrasound sensors, infrared sensors, acceleration sensors, imaging sensors, and microphones are used as the sensors.

8. Rail-guided transport system according to claim 1, wherein the vehicle is equipped with at least one on-board camera, which can be remote-controlled by the telematics central station.

* * * * *